United States Patent [19]

Couture

[11] Patent Number: 4,656,741

[45] Date of Patent: Apr. 14, 1987

[54] HAND HELD AND HAND OPERATED TOOL FOR CONTROLLABLY PUNCHING A SMALL AIR INTAKE HOLE IN A BURNED OUT REMOVED FLUORESCENT LIGHTING TUBE

[76] Inventor: Richard P. Couture, 1715 S. Washington, Tacoma, Wash. 98405

[21] Appl. No.: 786,300

[22] Filed: Oct. 10, 1985

[51] Int. Cl.[4] ..... B26F 1/36

[52] U.S. Cl. ..... 30/363; 30/124; 30/366

[58] Field of Search ..... 30/92, 124, 360, 363, 30/366; 408/105; 225/93, 103; 241/99

[56] References Cited

U.S. PATENT DOCUMENTS

| | | | |
|---|---|---|---|
| 295,052 | 3/1884 | Rose | 30/363 |
| 1,146,023 | 7/1915 | Ridgely | 30/124 |
| 1,338,540 | 4/1920 | Wake . | |
| 2,620,988 | 12/1952 | Tellier | 241/62 |
| 2,924,481 | 2/1960 | Wagstaff . | |
| 3,257,140 | 6/1966 | Lane . | |
| 3,330,489 | 7/1967 | Worman | 241/99 |
| 3,349,821 | 10/1967 | Moeller . | |
| 4,088,274 | 5/1978 | Smith | 241/99 |
| 4,574,477 | 3/1986 | Lemkin et al. | 30/92 |

FOREIGN PATENT DOCUMENTS

| | | | |
|---|---|---|---|
| 1537952 | 1/1979 | United Kingdom | 30/363 |

*Primary Examiner*—E. R. Kazenske
*Assistant Examiner*—Michael D. Folkerts
*Attorney, Agent, or Firm*—Roy E. Mattern, Jr.

[57] ABSTRACT

After the removal of a burned out fluorescent lighting tube and its transport to a waste collecting locale, a hand held and hand operated tool is inserted in part over a tube end. Thereafter upon creating a squeezing force, via the lever action of this tool, a sharp pointed cutter is safely driven through the glass of the tube. A small vent hole is created, through which air passes until the outside and inside air pressures are the same. Thereafter, the tube is safely and progressively hit against the rim of a waste container to break the tube into small waste pieces, which drop into this container. In a preferred embodiment, two lever portions of a hand width length, are hinged at their leading ends, which are sized to fit over and partially down the end of the fluorescent lighting tube. A sharp pointed cutter is set back a short distance from the leading edge of one lever portion and positioned within an internally threadable upright embossment. The cutter head is formed to receive a blade of a screwdriver used in threading this sharp pointed cutter down through the embossment and beyond into a tube end piercing or cutting position. A compression spring is positioned and secured to keep the free ends of the two lever portions apart at a selected convenient open starting angle, until the squeezing force is applied to press them together, thereby insuring the penetration of the sharp pointed cutter into the interior of the burned out fluorescent lighting tube.

8 Claims, 7 Drawing Figures

HAND HELD AND HAND OPERATED TOOL FOR CONTROLLABLY PUNCHING A SMALL AIR INTAKE HOLE IN A BURNED OUT REMOVED FLUORESCENT LIGHTING TUBE

BACKGROUND

In many situations today burned out fluorescent lighting tubes are still being dangerously disposed of by breaking them up, upon creating striking blows with them at the edge and over the interior of waste containers, before there is any controlled attempt to puncture them allowing the inside air pressure to increase to match the outside air pressure. If no equalization of the inside, outside air pressures is controllably undertaken, then upon striking the first blow, the air rushing in to destroy the vacuum status, creates a reactive explosive type of force which wildly distributes glass particles and phosphorus powders potentially being able to hurt the person's eyes and face.

Where burned out fluorescent lighting tubes are substantially and constantly being replaced in larger dwellings, a fluorescent lamp bulb breaking device is used, such as the one illustrated and described by Edgar H. Tellier, in his U.S. Pat. No. 2,620,988 issued in 1952. The fluorescent lamp bulb or tube is inserted end first down into a hollow-lead-in pipe and beyond into a chamber, housing a revolving four bladed impellor, which breakes up the glass tube into portions, which drop down into a collecting bin. A water stream flushes the broken tube pieces from within the impellor housing down into the collecting bin.

Also Robert G. Worman in his U.S. Pat. No. 3,330,489 granted in 1967, describes and illustrates his disposal device, which he designed to be used by persons, when they were crushing, puncturing, or otherwise treating articles such as glass lamp bulbs, metal cans and the like. He provided an end loading nestled assembly of two tubular members. A fluorescent tube is placed and held by the inner tubular member. Thereafter the tubular members are relatively rotated, and a tube contacting unit, secured to the inner member, is driven into destructive penetration of the burned out fluorescent tube, which is completely surrounded by the two nestled tubular members. Persons destroying the fluorescent tubes are protected from the explosive glass particles and phosphorus powders, which remain inside the nestled two tubular members.

There remained, however, a need for a small low cost hand held tool, which could be safely used by those persons who dispose of fewer burned out fluorescent tubes by breaking them at the locale of refuse cans, whereby the air pressures could be safely balanced, before the first breaking blow is undertaken, thereby avoiding any wild distribution of glass particles and phosphorus powders.

SUMMARY

For any persons desiring to break up burned out fluorescent light tubes, this hand held and hand operated tool should be used to puncture a small hole through the glass tube near its end. Air then safely rushes in through the small puncture to equalize the outside and inside air pressures. Thereafter, the fluorescent light tube is broken up during striking blows, which are undertaken, when the danger of injury has been drastically reduced, by eliminating the possibility of any wild explosive distribution of glass particles and phosphorus powders.

The tool is arranged for the hinged assembly of two lever portions of a hand width length. They are sized at their leading ends to slide over the end of a fluorescent tube a short distance, and then to internally abut the end of the fluorescent tube. After reaching such position, the lever portions are closed together, thereby driving a sharp pointed cutter into and through the glass of the fluorescent tube. This cutter is threadably and radially positioned by an embossment formed in one of the lever portions. Each lever portion, internally at its mid length, has a raised positioning receiver portion to receive and to hold the respective ends of a transversely positioned coiled spring, which keeps the lever portions spaced apart at a convenient angle, until the squeezing action is undertaken to controllably and safely pierce the fluorescent tube at its end. Such piercing locale of the fluorescent tube is then protectively surrounded by the overlapping hinged end portions of these lever portions of this hand held and hand operated tool.

DRAWINGS

A preferred embodiment of this hand held and hand operated tool, used in controllably and safely punching a small air intake hole in a burned out removed fluorescent lighting tube, is illustrated in the drawings, wherein:

FIG. 1 is a perspective view showing the end of a fluorescent tube being positioned, by using the left hand and arm of a person, and also showing this tool about to be passed around, in part, over the end of this fluorescent tube, by using the right hand and arm of a person, who subsequently compresses the two levers together, driving a sharp pointed cutter through the glass to create an air pressure;

FIG. 2 is a side view, with portions removed, for illustrating how the burned out fluorescent tube end is positioned with respect to this hand held and hand operated tool in preparation for passing the leading entry end of this tool over the end of this fluorescent tube;

FIG. 3 is a sectioned view showing how the hand held and hand operated tool has been inserted, in part, over the end of a fluorescent tube, until its internal abutment contacts the tube, and thereafter the hinged together lever portions ahve been squeezed together, against the spring force, thereby causing the sharp pointed cutter to pierce the glass creating the hole, through which air controllably enters to equalize the outside and inside air pressures;

Figure 6:
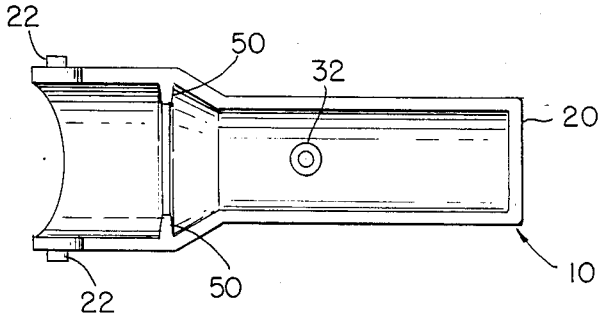
Figure 7:
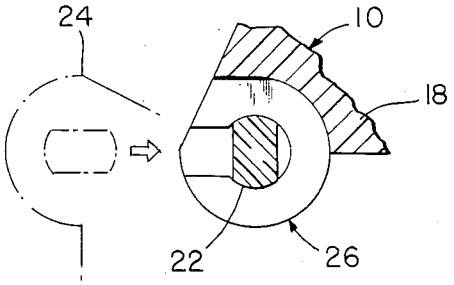

FIG. 6 is an inside view of the interior of the other lever portion, which includes the male portions of the hinge arranged to removably hold the leading ends of these hand sized lever portions together, which includes the internal abutments to contact the fluorescent tube end, and which includes the intergral internal raised receiver to hold the other spring end in place; and FIG. 7 is an enlarged partial view, with portions removed, and portions shown in phantom lines to illustrate how the hand sized lever portions are manipulated to be moved together and to be interlocked via their hinged portions.

DESCRIPTION OF THE PREFERRED EMBODIMENT

Figure 1:
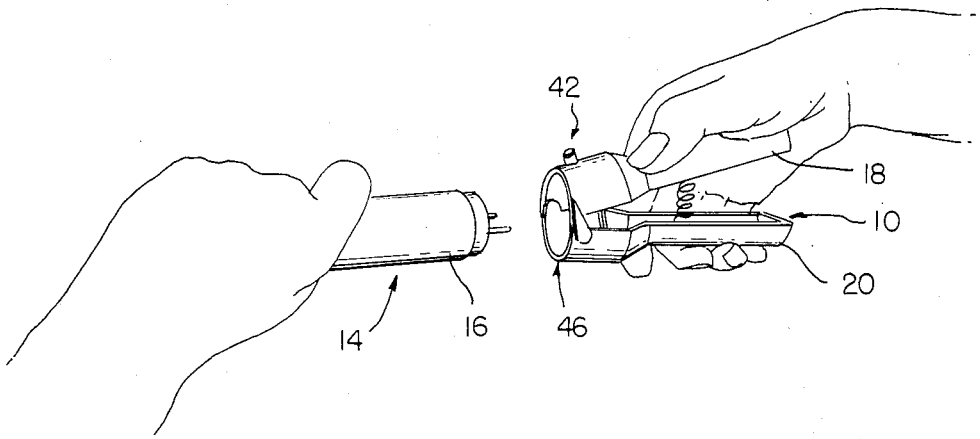
Figure 2:
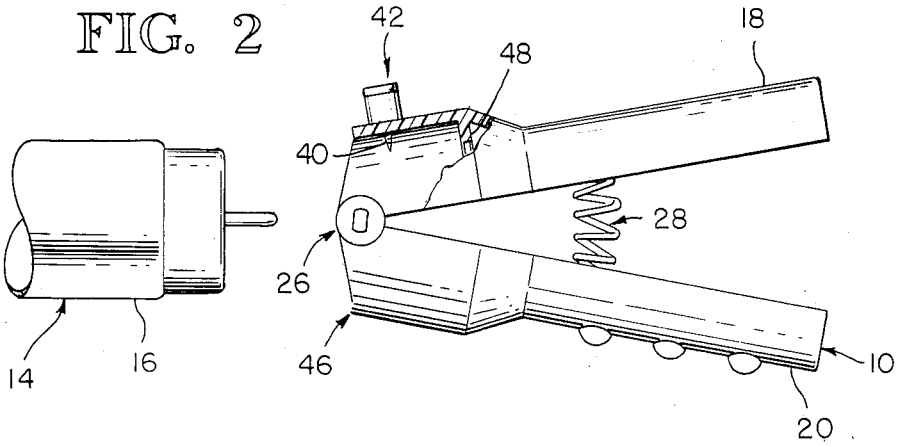

The hand held and hand operated tool 10, for controllably and safely punching a small air intake hole 12 in a burned out fluorescent tube 14, to permit the outside and inside air pressures to equalize, is illustrated in FIGS. 1 and 2, as it is positioned just prior to being inserted over the end 16 of the fluorescent tube 14. The two lever portions 18, 20 of a hand's width in length have been hinged together as shown in FIG. 7 as the respective male hinge portions 22 have been inserted into the respective female hinge portions 24, to created the hinge 26.

These hinged together lever portions 18, 20 are held apart by a compression spring 28. Respective internal embossments 30, 32, each one being in a respective lever portion 18, 20, and positioned opposite one another, frictionally hold and position the respective spring ends 34, 36.

Near the leading end of lever portion 18, an external upstanding embossment 38 threadably receives a sharp pointed end 40 of cutter 42 punch, or pin, serving as a glass piercing unit, which has a head 44 formed to receive the blade of a screwdriver, not shown. The cutter 42 is threaded radially inwardly a sufficient distance to insure the subsequent penetration of its pointed end 42 through the glass of the fluorescent lighting tube 14, to thereby create the air intake hole 12 vent, or orifice, serving as a small air intake passageway through which the air enters to equalize the outside and inside pressures.

Figure 3:
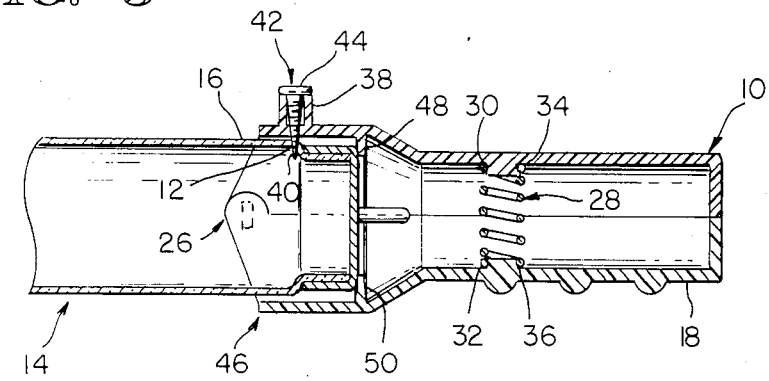
Figure 4:
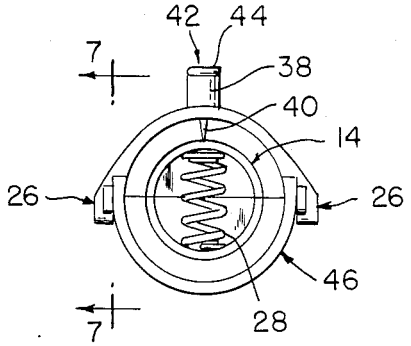
FIG. 4 is an end view looking into the entry end and beyond of this hand held and hand operated tool, when the hinged together lever portions have been squeezed together, also showing some portions of the fluorescent tube end to indicate the penetration of the sharp pointed cutter.

Such penetration is illustrated in FIGS. 3 and 4. The placement of the leading end 46 of the hand held and hand operated tool 10 about the end 16 of the fluorescent tube 14 is undertaken via axial movement until respective internal abutment shoulders 48, 50 contact the end 16 of the fluorescent tube 14. Then the lever portions 18 and 20 are squeezed together to drive the pointer end 40 of the cutter 42 through the glass 52 of the fluorescent lighting tube 14. Upon release of the lever portions 18, 20, the air intake hole 12 is cleared by the pointed end 40 of the cutter 42, and air enters to equalize the outside and inside air pressures.

Figure 5:
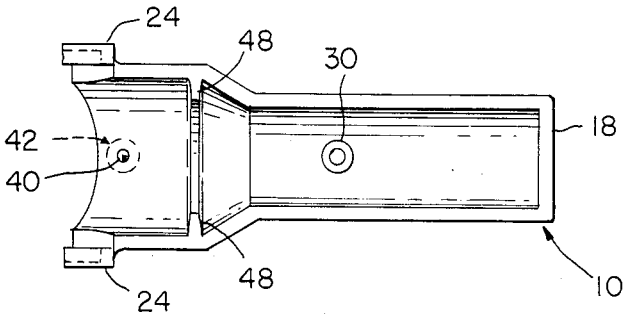
FIG. 5 is an inside view of the interior of the lever portion, which includes the external internally threadable abutment, which receives and positions the sharp pointed cutter, which includes the internal abutments to contact the fluorescent tube end, which includes the integral internal raised receiver to hold a spring end in place, and which includes the female portions of the hinge.

FIGS. 5 and 6, respectively illustrate the interiors of the lever portion 18 which supports the cutter 42, and has the female hinge portions 24 having a restrictive entry portion to a larger receiving volume portion, and the lever portion 20, which has the male hinge portions 22 having a rectangular projecting portion. Both lever portions have the respective internal abutment shoulders 48, 50 and respective internal embossments 30, 32 for frictionally holding and positioning the respective ends 34, 36 of the compression spring 28.

As so made of two molded lever portions 18, 20, which position the compression spring 28 and the cutter 42, this low cost, very effective hand held and hand operated tool 10, is quickly, conveniently and safely used to create the necessary air intake hole 12, through which the air flows to equalize the inside and outside pressures. Thereafter the following destructive blows undertaken to break up the burned out fluorescent tube 14 and collect the debris in a waste container is undertaken at a lower risk. The danger of any explosive distribution of glass particles and phosphorus powders has been initially safely eliminated.

I claim:

1. A hand held and hand operated tool for controllably equalizing the inside and outside air pressures of a burned out fluorescent lighting tube, before this tube is subsequently broken up for more convenient disposal, by controllably piercing the glass tube with a pin unit, to create a small air intake hole, vent, or orifice passageway, comprising:

(a) a pair of lever portions, each one of the lever portions having:

(1) a leading hollow entry semicircular housing end to internally receiver one half of the volume of an end of a fluorescent lighting tube;

(2) a trailing hand grippable end;

(3) two alike hinge forming portions diametrically spaced at the start of the leading hollow entry semicircular housing end, at the circumference thereof, and remaining completely clear of any entry of an end of a fluorescent lighting tube;

(4) an internal abutment within the leading hollow entry semicircular housing end, to stop the entry of a cylindrical end of a fluorescent lighting tube within this tool, to thereby position a starting glass portion of a fluorescent lighting tube spaced just inside the start of the leading hollow entry semicircular housing and spaced just beyond the two alike hinge forming portions;

(5) a spring end positioning receiver on the trailing hand grippable end;

(b) a spring extending between the spring end positioning receivers to hold the trailing hand grippable ends a diagonal distance apart, until lever portions are moved completely together;

(c) a glass piercing pin unit located in one lever portion of the pair of lever portions, between the hinge forming portions and the internal abutment, so the glass piercing unit is positioned at a starting glass portion of a fluorescent lighting tube;

whereby as the hand held and hand operated tool is axially slipped over an end of a burned out fluorescent lighting tube, using one hand to manipulate this tool and the other hand to hold this tube, as opposing hand forces are axially created, and, then pivotally closing this tool, using the one hand manipulating this tool to pivotally move together, the respective leading hollow entry semicircular housing ends, to thereby completely enclose an end of this tube, and in so doing this pivotal closing of the tool, a glass piercing pin unit will be forming and completing the small air intake passageway, and thereafter the outside and inside tube air pressures become the same, and then, when a burned out fluorescent lighting tube has such equal pressures, there will not be any explosive scattering of glass particles and/or phosphorus powders, when this tube is intentionally broken into several pieces for convenient disposal.

2. A hand held and hand operated tool, as claimed in claim 1, wherein:

the two alike hinge forming portions of each lever portion, in respect to one lever portion of the pair of lever portions are each formed as a female hinge portion, having a restrictive entry portion leading to a larger receiving volume portion, and, the two alike hinge forming portions of each lever portion, in respect to the other lever portion of the pair of lever portions, are each formed as a male hinge portion of rectangular projecting portion with the smaller dimension of the rectangular projecting portion being first entered into the restrictive entry portion, as this rectangular projecting portion is moved into the larger receiving volume portion, to complete the hinge interconnection of the two lever portions.

3. A hand held and hand operated tool, as claimed in claim 1, wherein the glass piercing pin unit is adjustably mounted to be periodically adjusted to always extend a preset given distance to insure the penetration of the glass end portion of the burned out fluorescent lighting tube, when the pair of lever portions complete their pivotal enclosure of the end of this lighting tube.

4. A hand held and hand operated tool, as claimed in claim 2, wherein the glass piercing pin unit is adjustably mounted to be periodically adjusted to always extend a preset given distance to insure the penetration of the glass end portion of the burned out fluorescent lighting tube, when a pair of lever portions complete their pivotal enclosure of the end of this lighting tube.

5. A hand held and hand operated tool, as claimed in claim 1, wherein the spring is a coiled spring, and the spring end positioning receivers are cylindrical projections to frictionally respectively receive an end of the coiled spring.

6. A hand held and hand operated tool, as claimed in claim 2, wherein the spring is a coiled spring, and the spring end positioning receivers are cylindrical projections to frictionally respectively receive an end of the coiled spring.

7. A hand held and hand operated tool, as claimed in claim 3, wherein the spring is a coiled spring, and the spring end positioning receivers are cylindrical projections to frictionally respectively receive an end of the coiled spring.

8. A hand held and hand operated tool, as claimed in claim 4, wherein the spring is a coiled spring, and the spring end positioning receivers are cylindrical projections to frictionally respectively receive an end of the coiled spring.

* * * * *